United States Patent [19]

Dunhem et al.

[11] 3,951,201

[45] Apr. 20, 1976

[54] METHOD OF CASTING OF MOLTEN METALS

[75] Inventors: Francois Dunhem; Andre Hettler, both of Donchery, France

[73] Assignee: Foseco International Limited, Birmingham, England

[22] Filed: Feb. 28, 1974

[21] Appl. No.: 447,053

[30] Foreign Application Priority Data

Mar. 7, 1973 United Kingdom ..... 11110/73

[52] U.S. Cl. ..... 164/123; 249/206

[51] Int. Cl.[2] ..... B22D 27/04; B22D 7/12

[58] Field of Search ..... 249/206; 164/55, 56, 164/57, 58, 59, 123

[56] References Cited

UNITED STATES PATENTS

| | | | |
|---|---|---|---|
| 1,184,523 | 5/1916 | Field | 249/206 UX |
| 3,189,315 | 6/1965 | Verna | 249/206 |
| 3,810,506 | 5/1974 | Kobayashi | 249/206 X |

FOREIGN PATENTS OR APPLICATIONS

| | | | |
|---|---|---|---|
| 825,087 | 12/1959 | United Kingdom | |
| 42,305 | 12/1971 | Japan | 249/206 |

*Primary Examiner*—J. Howard Flint, Jr.
*Assistant Examiner*—John E. Roethel
*Attorney, Agent, or Firm*—Cushman, Darby & Cushman

[57] ABSTRACT

A method of casting an ingot which comprises locating in an ingot mould a vertical tube of fibrous heat-insulating material of melting point less than the casting temperature of the metal of the ingot, and teeming molten metal into the mould.

10 Claims, 1 Drawing Figure

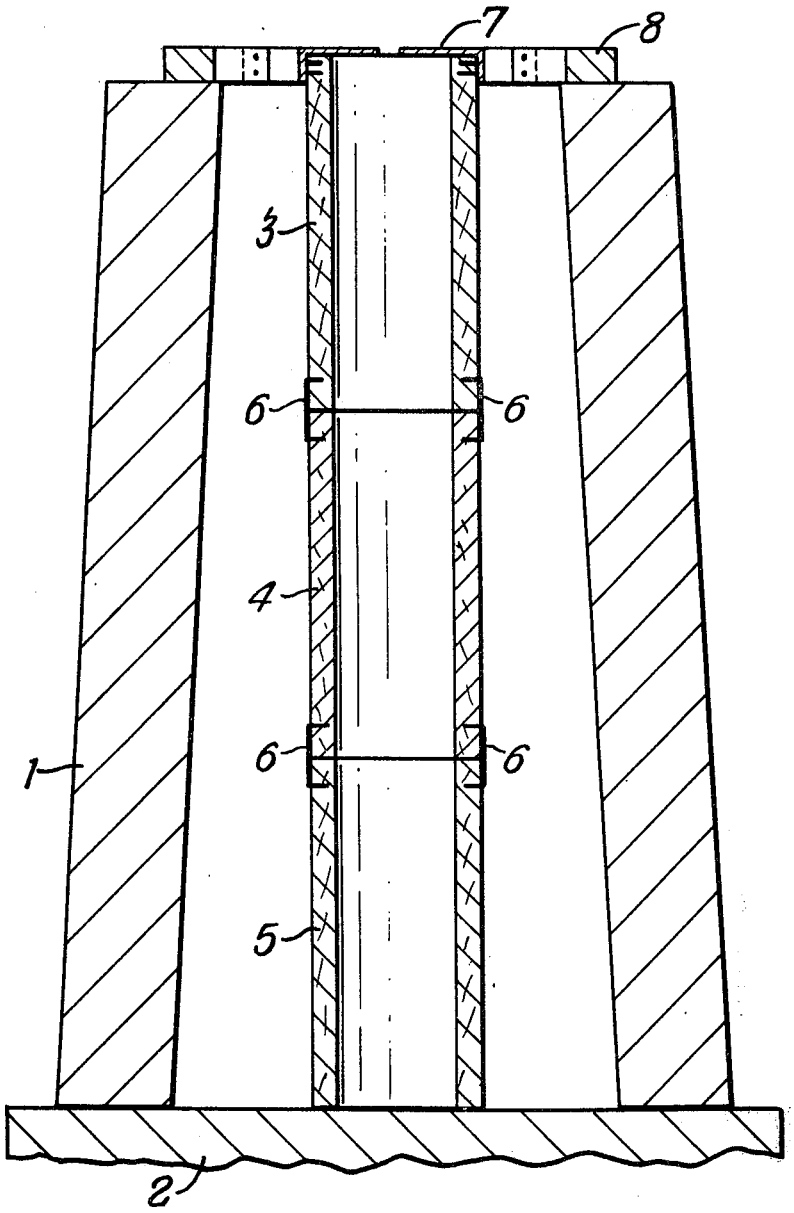
7
8
3
6
6
4
6
6
1
5
2

METHOD OF CASTING OF MOLTEN METALS

This invention relates to the casting of molten metals to form ingots.

There are two principal methods of pouring molten metal to cast ingots: top pouring and bottom pouring. Top pouring is simple to carry out but has several disadvantages: the molten metal is subject to considerable turbulence, splashing takes place, and as a result, there is a tendency for non-metallic inclusions to become entrapped in the molten metal. Additionally, the ingot mould is subjected to highly erosive forces which tend to reduce the life of the mould or base plate thereof.

Bottom pouring avoids these disadvantages but is generally inconvenient to use and requires the provision of much equipment, and setting up the moulds requires more time and labour.

According to the present invention there is provided a method of casting an ingot which comprises locating in an ingot mould a vertical tube of fibrous heat insulating material, of melting point less than the casting temperature of the metal of the ingot and teeming molten metal into the mould. Preferably the molten metal is teemed into the mould from above through the tube, though the metal can be teemed from below if desired. As the molten metal surface rises up the mould, the fibrous tube slowly melts. The melted tube flows over the surface of the molten metal and forms both a casting flux and a mould wall coating. Suitable fibres are calcuim or aluminium silicate fibres and glass fibres. Commercially available impure materials such as rock wool and slag wool may be used. The tube may be of felted or bonded fibre and may contain other ingredients to enhance the flowing action.

The tube may be one piece or may be made up of a number of sections suitably fitted or attached, for example adhesively attached, together. Preferably coaxial section are abutted and held together by staples pinned across the joint between them. Alternatively, the tube may be made up of two half-tubes each of semicircular cross-section.

The tube may be located in the ingot mould before teeming commences by any convenient holding and positioning means (engaging the top of the mould), for example, clips, tie wires or stays. One particular method is to locate the upper end in a collar mounted in a frame which rests on the top of the ingot mould.

The material of the tube may also contain metal treatment agents or agents aiding in securing ingots of high quality and surface finish. For example, the tube may contain materials to generate a non-oxidising atmosphere over the rising metal surface and thus reduce the number of oxide inclusions in the final cast ingot, and/or it may contain materials having a fluidising effect on metallic oxides and refractory substances.

For use in the casting of steel, one type of composition for the sleeve falls within the following ranges (% by weight):

| | |
|---|---|
| calcium silicate fibre | 10 – 40% |
| blast furnace slag (crushed) | 10 – 40% |
| fluorspar | 5 – 15% |
| organic fibre (e.g. paper pulp) | 1 – 5% |
| binder | 4 – 7% |

Numerous other types of material may, however, be used for the sleeve, for example the types exemplified below.

The invention is illustrated, by way of example, in the accompanying drawing which shows diagrammatically a section through an ingot mould prior to teeming.

Referring to the drawing, an ingot mould 1 bearing a base plate 2 has located on its base a tube consisting of three tube sections 3, 4, 5. The sections are attached together by staples 6. The top of the tube is held centrally in the aperture at the top of the mould 1, by engagement in an internally spiked collar 7 which is connected to a heavy frame 8, which rests on top of mould 1. Frame 8 serves to hold the tube steady and to hold it down during teeming. In use, molten metal is teemed through the tubes and as teeming progresses tubes 5,4 and 3 melt, in that order, to provide a casting flux and a mould wall coating.

The following examples serve to illustrate the present invention:

EXAMPLE 1.

A hollow cylindrical tube was made up from the following composition:

| | |
|---|---|
| calcium-silicate fibers | 92% by weight |
| phenol-formaldehyde resin | 8% by weight |

The tube comprises four interlocking sections which together weighed 25kg. This tube was inserted into an 8 ton ingot mould and molten steel at 1650°C was teemed directly through the tube into the ingot mould. During the teeming operation the tube was progressively melted at the same rate as the molten metal was introduced into the mould. The tube melted to form a fluid slag. At the end of the teeming operation it was observed that the upper surface of the solidifying ingot was covered by a layer of slag. On solidification, this forms a heat insulating cover over the ingot and thus aids in minimising the formation of pipe in the ingot. Furthermore, after stripping the ingot from the mould, the ingot was found to possess a clean surface which was substantially free from defects and non-metallic inclusions.

EXAMPLE 2.

The above example was repeated but in this case the composition of the tube was:

| | |
|---|---|
| calcium silicate slag wool fiber | 75% by weight |
| fluorspar | 10% by weight |
| titanium dioxide | 10% by weight |
| phenolformaldehyde resin | 5% by weight |

The results obtained with this tube were satisfactory and similar to those obtained in Example 1.

EXAMPLE 3.

Two tube sections of resin-bonded rock wool were assembled with staples to form a tube 180 cm high, 25 cm across and of wall thickness 3.8 cm.

This was located in a collar as shown in the accompanying drawing and set in a 5 ton ingot mould.

Killed steel was then teemed at 1650°C. After cooling, solidification and stripping, the ingot was found to have excellent surface finish.

We claim:

1. A method of casting an ingot which comprises locating in an ingot mould a vertical tube of fibrous heat insulating inorganic silicate material, said tube having a melting point less than the casting temperature of the metal of the ingot, and teeming molten metal into the mould.

2. A method according to claim 1 wherein the metal is teemed from above through the tube.

3. A method according to claim 1 wherein the vertical tube is formed of material selected from the group consisting of bonded calcium silicate fibre, felted calcium silicate fibre, aluminium silicate fibre and glass fibre.

4. A method according to claim 1 wherein the tube is formed of resin-bonded rock wool.

5. A method according to claim 1 wherein the tube is held at its upper end by holding and positioning means engaging the top of the mould.

6. A method according to claim 1 wherein the material of the vertical tube contains a material selected from the group consisting of fluxing agents.

7. A method according to claim 1 wherein the tube is made up from a plurality of vertically extending sections attached together.

8. A method according to claim 1 wherein the material of the vertical tube contains a material selected from the group consisting of metal treatment agents.

9. A method according to claim 1 wherein the tube is formed of resin-bonded slag wool.

10. A metal ingot cast by the method of locating in an ingot mould a vertical tube of fibrous heat insulating inorganic silicate material of melting point less than the casting temperature of the metal of the ingot, and teeming molten metal into the mould.

* * * * *